US006822392B2

(12) United States Patent
Behr et al.

(10) Patent No.: US 6,822,392 B2
(45) Date of Patent: Nov. 23, 2004

(54) INCANDESCENT LAMP FOR MOTOR VEHICLE HEADLIGHTS

(75) Inventors: Gerhard Behr, Altheim (DE); Manfred Bühler, Herbrechtingen (DE); Christian Seichter, Herbrechtingen (DE); Klaus Wittmann, Sontheim (DE)

(73) Assignee: Patent-Treuhand-Gesellschaft fur elektrische Gluhlampen mbH, Munich (DE)

( * ) Notice: Subject to any disclaimer, the term of this patent is extended or adjusted under 35 U.S.C. 154(b) by 0 days.

(21) Appl. No.: 10/408,318

(22) Filed: Apr. 8, 2003

(65) Prior Publication Data

US 2003/0189404 A1 Oct. 9, 2003

(30) Foreign Application Priority Data

Apr. 8, 2002 (DE) ..... 102 15 397

(51) Int. Cl.[7] ..... H01K 1/26

(52) U.S. Cl. ..... 313/578; 313/315; 362/214

(58) Field of Search ..... 313/240, 578, 313/580, 315, 613, 239, 110, 116; 362/211, 214, 239, 548, 226

(56) References Cited

U.S. PATENT DOCUMENTS 5,725,298 A 3/1998 Kalze et al.
6,709,130 B2 * 3/2004 Behr et al. ..... 362/214

* cited by examiner

*Primary Examiner*—Vip Patel
*Assistant Examiner*—Glenn D. Zimmermann
(74) *Attorney, Agent, or Firm*—William E. Meyer

(57) ABSTRACT

The invention relates to an incandescent lamp for a motor vehicle headlight. The secondary filament (2) is arranged in such a way that, in a projection plane that is arranged perpendicular to the reference plane (B), the edge (2*a*), facing the antidazzle device (4), of the image, projected onto the projection plane, of the second incandescent filament (2) is arranged over the entire length of the second incandescent filament (2) between the reference axis (A) and the anti-dazzle device (4), and the edge (2*a*), facing the antidazzle device (4), of the image, projected to the scale 1:1 onto the projection plane, of the second incandescent filament (2) has a prescribed spacing from the reference axis (A). It is thereby possible to produce the light/dark boundary for the lower beam with the aid of the edge (2*a*) of the secondary filament image (2).

2 Claims, 2 Drawing Sheets

INCANDESCENT LAMP FOR MOTOR VEHICLE HEADLIGHTS

Figure 1:
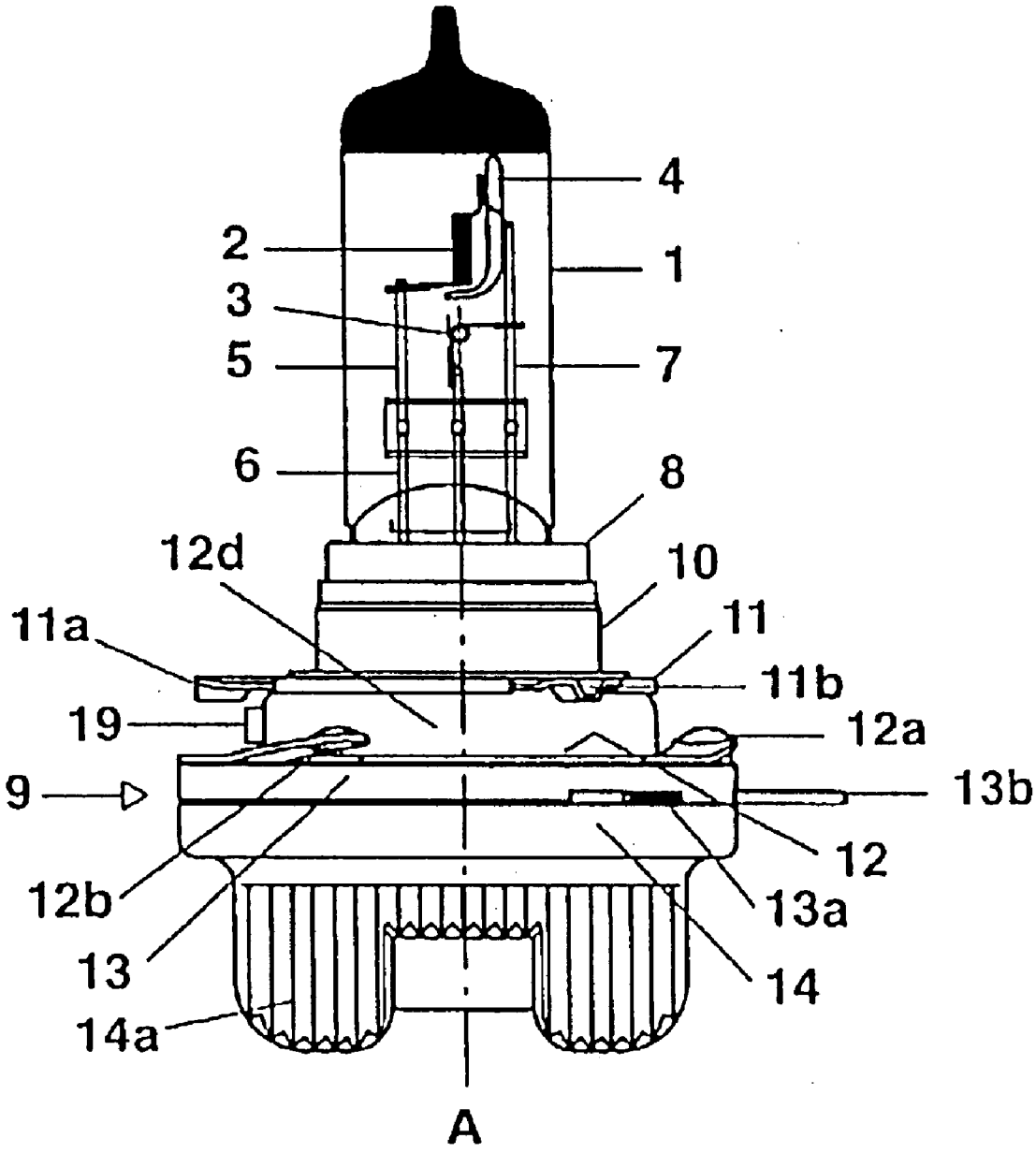

The invention relates to an incandescent lamp for motor vehicle headlights having two filaments and an antidazzle device.

I. BACKGROUND ART

Such an incandescent lamp is disclosed, for example, in European laid-open application EP 791 779 A2. This laid-open application describes an incandescent lamp with a secondary filament for generating the lower beam, and a primary filament for generating the upper beam in a motor vehicle headlight. Furthermore, the incandescent lamp has an antidazzle device that is arranged in the lamp vessel and shields a portion of the light generated by the secondary filament. The antidazzle device is used to produce the light/dark boundary of the lower beam. In particular, the shape of the antidazzle device is adapted appropriately for this purpose. It is disadvantageous in this case that producing the light/dark boundary requires a large portion of the light generated by the secondary filament to be shaded by the antidazzle device, with the result that it is not available for illuminating the road.

II. DISCLOSURE OF THE INVENTION

It is the object of the invention to render a larger portion of the light generated by the lower beam filament available for the illumination of the road in a generic incandescent lamp.

A substantial aspect of the present invention is that the antidazzle device is no longer used to produce the light/dark boundary, but instead the light/dark boundary is fixed solely by the position and orientation of the secondary filament with reference to the headlight reflector. The inventive incandescent lamp has the following features for this purpose:

- a transparent lamp vessel with a first incandescent filament arranged therein, and a second incandescent filament arranged therein,
- a lamp base in which the lamp vessel is anchored, the lamp base defining a reference plane and having a longitudinal axis that is aligned perpendicular to the reference plane, serves as reference axis, and with reference to which at least the second incandescent filament is aligned,
- the first incandescent filament is aligned transverse to the reference axis, and the second incandescent filament is aligned substantially parallel to the reference axis,
- the lamp base has means for installing the incandescent lamp in the correct position in a motor vehicle headlight,
- an antidazzle device, arranged in the lamp vessel, for shading a portion of the light emitted by the second incandescent filament, the second incandescent filament being arranged in such a way that, in a projection plane that is arranged perpendicular to the reference plane,

- the edge, facing the antidazzle device, of the image, projected onto the projection plane, of the second incandescent filament is arranged over the entire length of the second incandescent filament between the reference axis and the antidazzle device, and
- the edge, facing the antidazzle device, of the image, projected to the scale 1:1 onto the projection plane, of the second incandescent filament has a prescribed spacing from the reference axis.

When the inventive incandescent lamp is being mounted in a motor vehicle headlight, the means arranged in the lamp base for installing the lamp in the correct position between the optical axis of the headlight reflector and the reference plane of the lamp base as well as the longitudinal axis, serving as reference axis, of the lamp base produce a well defined spatial relationship such that the reference plane and the longitudinal axis of the lamp base can be used not only to adjust the incandescent filaments in the lamp, but that this adjustment at the same time also signifies an adjustment of the incandescent filaments with reference to the optical axis of the headlight reflector. When the lamp is correctly mounted in a headlight, the optical axis of the headlight reflector and the longitudinal axis of the lamp base are usually identical. According to the invention, the second incandescent filament, which is the secondary filament serving to generate the lower beam, is arranged in such a way that, in a projection plane that is arranged perpendicular to the reference plane, the edge, facing the antidazzle device, of the image, projected onto the projection plane, of the second incandescent filament is arranged over the entire length of the second incandescent filament between the reference axis and the antidazzle device, and the edge, facing the antidazzle device, of the image, projected to the scale 1:1 onto the projection plane, of the second incandescent filament has a prescribed spacing from the reference axis. This ensures that only light from a relatively narrow angular region is shaded by the surface of the second incandescent filament facing the antidazzle device, and the contour of the second incandescent filament, in particular the contour of the part of the filament surface facing the antidazzle device, can be used to produce the light/dark boundary of the lower beam. The value for the abovementioned spacing from the reference axis is preferably 0.7 mm, in order to keep as slight as possible the influence of mirror images of the secondary filaments that are generated by the lamp vessel.

The value of the abovementioned prescribed spacing is advantageously fixed with an accuracy of ±0.3 mm in order to permit an optimal adaptation between the lamp and headlight reflector. An even narrower tolerance limit preferably applies to the spacing from the end of the second incandescent filament, arranged closer to the reference plane, from the reference axis. At the end of the second incandescent filament arranged closer to the reference plane, the accuracy for the abovementioned prescribed spacing value of the edge, facing the antidazzle device, of the image of the second incandescent filament projected, onto the projection plane to the scale 1:1, from the reference axis is preferably fixed at approximately ±0.2 mm. The antidazzle device now only serves the purpose of shielding the regions of the headlight reflector from the light of the secondary filament that are reserved for the upper beam generated by the primary filament, and of shading the two incandescent filaments from one another.

In order to be able to illuminate the road with as much light as possible from the second incandescent filament, the side edges of the antidazzle device advantageously have, over the entire length of the second incandescent filament, a greater spacing from the plane, which contains the reference axis and is arranged perpendicular to the reference plane and to the projection plane, than the edge, facing the antidazzle device, of the image of the second incandescent filament projected onto the projection plane. For this purpose, the antidazzle device and the second incandescent filament are preferably arranged in such a way that, in an arbitrary plane arranged parallel to the reference plane and intersecting the second incandescent filament, the two tangents to the surface, facing the antidazzle device, of the second incandescent filament, which in each case run through a side edge of the antidazzle device, in each case form an angle of at least 10 degrees with the plane arranged perpendicular to the projection plane and to the reference plane, and containing the reference axis.

Moreover, in order to shade a sufficiently large solid angle from the light emitted by the second incandescent filament, in an arbitrary plane, arranged parallel to the reference plane and intersecting the second incandescent filament, the two tangents to the surface, averted from the antidazzle device of the second incandescent filament, which in each case run through a side edge of the antidazzle device, advantageously form an angle of at least 110 degrees with one another.

The spacing of the second incandescent filament from the reference plane is advantageously 30.0 mm±0.2 mm. This relatively large spacing ensures that the lamp base is not exposed to high thermal stress during operation of the lamp. Moreover, the narrow limits for the spacing value permit an optimal adaptation of the headlight reflector to the lamp.

III. BRIEF DESCRIPTION OF THE DRAWINGS

Figure 2:
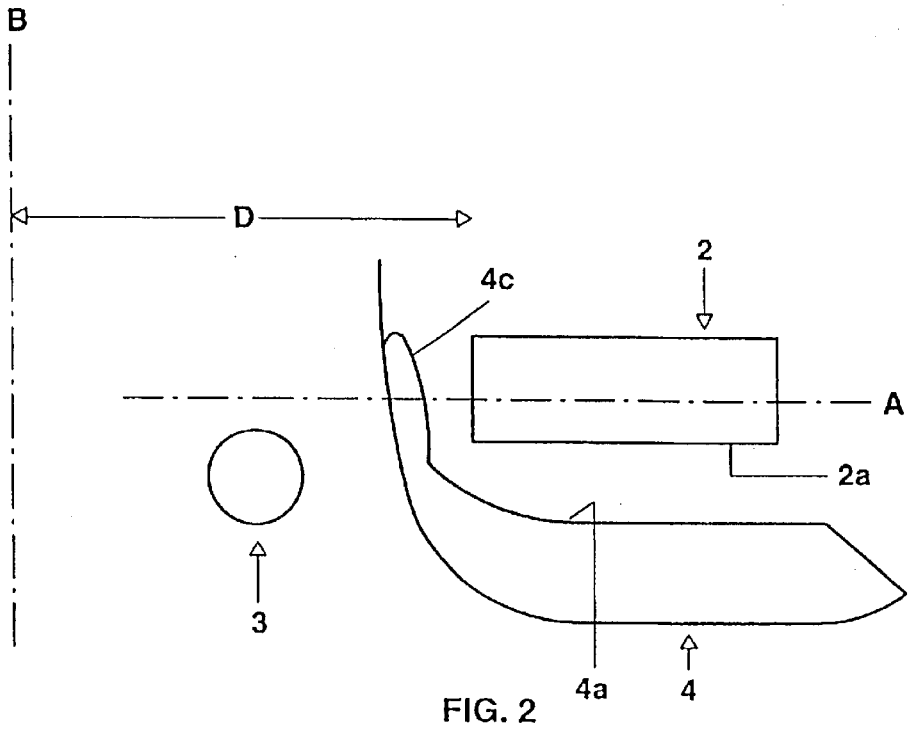
Figure 3:
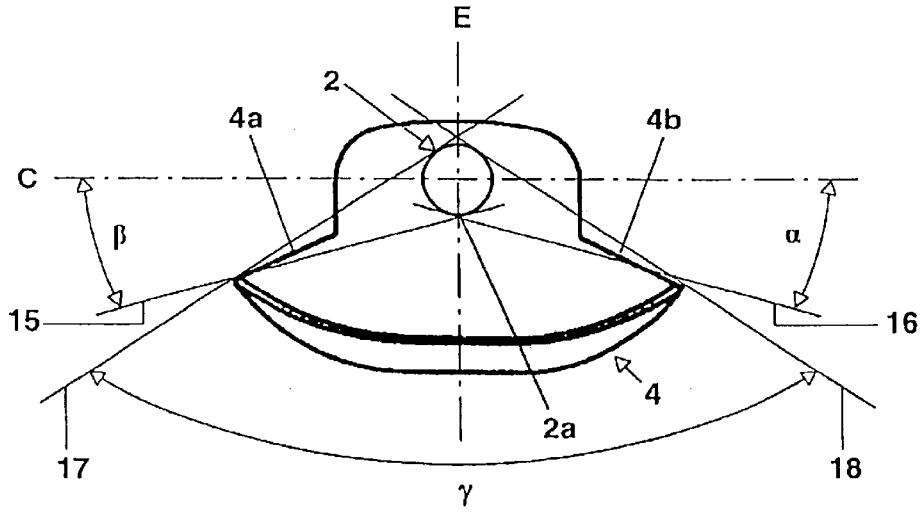

The invention is explained in more detail below with the aid of a preferred exemplary embodiment. In the drawing:

FIG. 1 shows a side view of the inventive incandescent lamp in accordance with the preferred exemplary embodiment of the invention, FIG. 2 shows a projection of the incandescent filaments and of the antidazzle device of the exemplary embodiment depicted in FIG. 1 onto a projection plane perpendicular to the reference plane, and FIG. 3 shows a schematic plan view of the antidazzle device and the second incandescent filament of the exemplary embodiment depicted in FIG. 1.

III. BEST MODE FOR CARRYING OUT THE INVENTION

The preferred exemplary embodiment, illustrated in FIG. 1, of the invention is a two-filament halogen incandescent lamp which is provided for insertion into a motor vehicle headlight. This lamp has a vitreous, essentially cylindrical lamp vessel 1, inside which there are enclosed two incandescent filaments 2, 3 of which one is arranged axially and the other transverse to the longitudinal axis A of the lamp base. The axially aligned incandescent filament 2 is surrounded in part by an antidazzle device 4, likewise arranged inside the lamp vessel 1. Three supply leads 5, 6 and 7, which are led out of the end of the lamp vessel 1 near the base, serve to hold and supply voltage to the incandescent filaments 2, 3 and the antidazzle device 4. The end of the lamp vessel 1 near the base is anchored with a clamping fit in a cutout in a metallic holder 8 which is, for its part, a component of the lamp base 9. The metallic holder 8 is fixed in the metallic adjusting ring 10 which is welded to the reference ring 11. The reference ring 11 has three reference noses 11*a*, 11*b* (only one of the reference noses 11*b* is shown) which extend radially outward substantially perpendicular to the longitudinal axis A and lie in a common plane. The longitudinal axis A is the ring axis of the reference ring 11, and the abovementioned plane forms the reference plane B on the lamp base. The reference noses 11*a*, 11*b* are arranged along the circumference of the reference ring 11 at a spacing of 120 degrees. The reference nose 11*a* is wider in design than the other two reference noses 11*b*, in order to define an orientation or installation position of the lamp in the headlight. By means of the conventional adjusting processes, during welding of the metal base parts 8, 10 and 11 the two incandescent filaments 2, 3 are aligned exactly with reference to the three reference noses 11*a*, 11*b* and the reference plane defined by them, such that the orientation and installation position of the three reference noses 11*a*, 11*b* inside the headlight reflector can also uniquely fix the arrangement of the incandescent filaments 2, 3 in the reflector during insertion of the lamp into a headlight. The reference ring 11 is welded to the metallic, annular base flange 12, whose flange plane is arranged substantially perpendicular to the longitudinal axis A. The base flange 12 has three resiliently designed lugs 12*a*, 12*b* (only two lugs are shown) which are arranged uniformly along its annular circumference and develop a spring action in the longitudinal direction A of the lamp. The reference noses 11*a*, 11*b* serve as opposing bearings to the resilient lugs. The reference noses 11*a*, 11*b* form a bayonet lock together with the base flange 12 and its lugs 12*a*, 12*b*, as well as with the opening, correspondingly configured as a lamp holder, of the headlight reflector. After the locking of the bayonet lock, the rim of the abovementioned opening of the headlight reflector is arranged with a clamping fit between the reference noses 11*a*, 11*b* and the lugs 12*a*, 12*b*. Serving to provide lateral support for the lamp at the rim of the headlight reflector opening is a press-on spring 19 which projects outward through a cutout in the annular collar 12*d* of the base flange 12.

Adjoining the base flange 12 is the plastic ring 13, from which there project three metallic contact lugs 13*a*, 13*b* (only two contact lugs are shown), which are connected in each case in an electrically conducting fashion to a supply lead 5, 6 and form the electric contacts of the headlight lamp. The three contact lugs 13*a*, 13*b* and, in particular, also their contact surfaces, are arranged in a common plane perpendicular to the axis of the plastic ring 13, and thus also substantially perpendicular to the longitudinal axis A. They 13*a*, 13*b* extend in the radial direction and project radially from the plastic ring 13. Three contact lugs 13*a*, 13*b* are arranged along the circumference of the plastic ring 13 at a spacing of 60 degrees in each case. The plastic ring 13 is provided with a radially running groove 16, serving as a positioning aid, for the purpose of fixing the position of the contact lugs 13*a*, 13*b* with reference to the reference noses 11*a*, 11*b* when mounting the base. One of the contact lugs 13*b* is arranged diametrically relative to the wide reference lug 11*a*. The rotary movement during locking of the bayonet lock causes the contact lugs 13*a*, 13*b* to make contact with the corresponding electrical holder contacts of the headlight.

The end, averted from the lamp vessel 1, of the lamp base 9 is formed by the grip part 14, which consists of plastic and is fixed by an undetachable plug-in connection on the plastic ring 13 and on the base flange 12. The grip part 14 has a web 14*a* running perpendicular to the longitudinal axis A along a diameter of the plastic ring 13. The web 14*a* can serve as a grip for locking and unlocking the bayonet lock when changing the lamp.

The alignment and position of the incandescent filament 2 are explained in more detail with the aid of FIGS. 2 and 3. The incandescent lamp depicted in FIG. 1 is operated in a horizontal position upon correct mounting of the lamp in the motor vehicle headlight. When the lamp is correctly mounted, two incandescent filaments 2, 3 are respectively arranged in a horizontal plane, specifically in such a way that—with the exception of the erect shader nose 4*c*—the antidazzle device 4 is arranged below the second incandescent filament 2. FIG. 2 shows a highly schematic illustration of a projection of the incandescent filaments 2, 3 and the antidazzle device 4 onto a projection plane E that is arranged perpendicular to the reference plane B and perpendicular to the coil axis of the first incandescent filament 3. In the illustration in accordance with FIG. 2, the second incandescent filament 2 has a substantially rectangular image. In order to produce a well defined light/dark boundary for the lower beam, the second incandescent filament 2 is arranged in such a way that, given a true-to-length projection (scale 1:1) of the second incandescent filament 2 onto the above-mentioned projection plane E, the lower edge 2*a* of the image of the second incandescent filament 2 is arranged at a spacing of 0.7 mm±0.3 mm below the longitudinal axis A. It is even the case that only a tolerance of ±0.2 mm for the spacing of the edge 2*a* of the image from the longitudinal axis A holds for the end of the second incandescent filament 2 situated closer to the reference plane B. That is to say, the lower edge 2*a* of the image of the second incandescent filament 2 is arranged 0.7 mm±0.2 mm below the longitudinal axis A at the end of the second incandescent filament 2 arranged closer to the reference plane B. The spacing D of the second incandescent filament 2 from the reference plane B is 30.0 mm±0.2 mm. The antidazzle device 4 is arranged so far below the second incandescent filament 2 that the sidewalls 4*a*, 4*b* do not cover the lower edge 2*a* of the image of the incandescent filament 2 in the projection shown in FIG. 2.

The relative arrangement of the antidazzle device 4 and the second incandescent filament 2 is depicted in FIG. 3. This figure shows a plan view of the antidazzle device 4 and the second incandescent filament 2 in the direction of the longitudinal axis A. The antidazzle device 4 is arranged so far below the second incandescent filament 2 that in an arbitrary plane of section, arranged parallel to the reference plane (B), through the second incandescent filament (2), the tangents 15, 16 to the lower surface, facing the antidazzle device 4, of the second incandescent filament 2, which in each case include a side edge 4*a* or 4*b*, respectively, of the antidazzle device 4, form an angle β or α, respectively, of in each case at least 10 degrees with the horizontal plane C. Moreover, the antidazzle device 4 is designed in such a way that in an arbitrary plane of section, arranged parallel to the reference plane (B), through the second incandescent filament (2), the tangents 17, 18 to the upper surface, averted from the antidazzle device 4, of the second incandescent filament 2, which in each case include a side edge 4*a* or 4*b*, respectively, of the antidazzle device 4, enclose an angle γ of at least 110 degrees.

What is claimed is:

1. An incandescent lamp for motor vehicle headlights, the incandescent lamp having the following features:

a transparent lamp vessel with a first incandescent filament arranged therein, and a second incandescent filament arranged therein, a lamp base in which the lamp vessel is anchored, the lamp base defining a reference plane and having a longitudinal axis that is aligned perpendicular to the reference plane, serves as reference axis, and with reference to which at least the second incandescent filament is aligned, the first incandescent filament is aligned transverse to the reference axis, and the second incandescent filament is aligned substantially parallel to the reference axis, the lamp base has means for installing the incandescent lamp in the correct position in a motor vehicle headlight, an antidazzle device, arranged in the lame vessel, for shading a portion of the light emitted by the second incandescent filament, wherein the second incandescent filament is arranged in such a way that, in a projection plane that is arranged perpendicular to the reference plane, the edge, facing the antidazzle device, of the image, projected onto the projection plane, of the second incandescent filament is arranged over the entire length of the second incandescent filament between the reference axis and the antidazzle device, and the edge, facing the antidazzle device, of the image, projected to the scale 1:1 onto the projection plane, of the second incandescent filament has a prescribed spacing from the reference axis, wherein the value for the prescribed spacing is 0.7 mm.

2. An incandescent lamp for motor vehicle headlights, the incandescent lamp having the following features:

a transparent lamp vessel with a first incandescent filament arranged therein, and a second incandescent filament arranged therein, a lamp base in which the lamp vessel is anchored, the lamp base defining a reference plane and having a longitudinal axis that is aligned perpendicular to the reference plane, serves as reference axis, and with reference to which at least the second incandescent filament is aligned, the first incandescent filament is aligned transverse to the reference axis, and the second incandescent filament is aligned substantially parallel to the reference axis, the lamp base has means for installing the incandescent lamp in the correct position in a motor vehicle headlight, an antidazzle device, arranged in the lamp vessel, for shading a portion of the light emitted by the second incandescent filament, wherein the second incandescent filament is arranged in such a way that, in a projection plane that is arranged perpendicular to the reference plane, the edge, facing the antidazzle device, of the image, projected onto the projection plane, of the second incandescent filament is arranged over the entire length of the second incandescent filament between the reference axis and the antidazzle device, and the edge, facing the antidazzle device, of the image, projected to the scale 1:1 onto the projection plane, of the second incandescent filament has a prescribed spacing from the reference axis wherein the spacing of the second incandescent filament from the reference plane is 30.0 mm±0.2 mm.

* * * * *